US008611780B2

(12) United States Patent
Yona et al.

(10) Patent No.: US 8,611,780 B2
(45) Date of Patent: Dec. 17, 2013

(54) REGULATING TEMPERATURE OF A ROLLER DEVICE

(75) Inventors: Yaniv Yona, Nes Zions (IL); Avichay Mor-Yosef, Jerusalem (IL); Boaz Eden, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 155 days.

(21) Appl. No.: 13/173,629

(22) Filed: Jun. 30, 2011

(65) Prior Publication Data

US 2013/0004197 A1 Jan. 3, 2013

(51) Int. Cl.
*G03G 21/20* (2006.01)
*G03G 15/01* (2006.01)

(52) U.S. Cl.
USPC ..... 399/94; 399/302

(58) Field of Classification Search
USPC ..... 399/94, 292, 57, 302; 219/600; 492/27, 492/36, 37
See application file for complete search history.

(56) References Cited

U.S. PATENT DOCUMENTS

| | | | | |
|---|---|---|---|---|
| 5,048,418 | A | 9/1991 | Hars et al. | |
| 5,180,002 | A * | 1/1993 | Schwarz | 165/89 |
| H1135 | H * | 2/1993 | Schwartz | 399/57 |
| 6,571,711 | B1 | 6/2003 | Bostrack | |
| 6,892,639 | B2 | 5/2005 | Compton et al. | |
| 7,111,552 | B2 | 9/2006 | Kolbe et al. | |
| 2005/0235979 | A1 * | 10/2005 | Whittaker | 126/19.5 |
| 2011/0135334 | A1 * | 6/2011 | Sato | 399/69 |

FOREIGN PATENT DOCUMENTS

| | | | | |
|---|---|---|---|---|
| CN | 101704315 A | | 5/2010 | |
| JP | 11138742 | | 5/1999 | |
| JP | 11138742 A | * | 5/1999 | B41F 13/22 |
| JP | H11-138742 | * | 5/1999 | B41F 13/22 |

OTHER PUBLICATIONS http://www.plas-video.com/Printing/central-drum-flexo-printing-maching.html.

* cited by examiner

*Primary Examiner* — Clayton E Laballe
*Assistant Examiner* — Jas Sanghera
(74) *Attorney, Agent, or Firm* — Angela Mae Coxe

(57) ABSTRACT

A roller device includes a cylinder member. The cylinder member includes wall member having a plurality of channels that are disposed within the wall member. The channels circulate a fluid therein to uniformly regulate a temperature of the cylinder member.

20 Claims, 8 Drawing Sheets

REGULATING TEMPERATURE OF A ROLLER DEVICE

BACKGROUND

Image forming apparatuses, such as liquid electrophotography (LEP) systems, form images on media. Liquid electrophotography systems include a fluid applicator unit, a photoconductive member, an image transfer member, and an impression member. The image formed on the photoconductive member is transferred to the image transfer member, and then is provided to the media. An impression member may be used to transfer the image from the image transfer member to the media. Regulating the temperature of the media may be used to assist with the transfer of the image to the media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

A roller device, such as an impression member, is described herein. During the printing process, the temperature of the paper may need to be regulated to avoid low print quality. For example, the amount of friction between the roller device and the media may cause the impression drum to obtain a temperature above or below a predetermined temperature for printing, i.e., above or below fifty degrees Celsius. Consequentially, the temperature of the media may vary above or below the predetermined temperature, potentially resulting in low print quality. Accordingly, efficiently and uniformly regulating the temperature of a roller device to maintain the media at the predetermined temperature is desired.

Regulating the temperature of the roller device may also regulate the temperature of the media. For example, the friction between a thin media and the roller device may cause the roller device to reach a temperature in excess of the predetermined temperature, resulting in the media heating to a temperature above fifty degrees Celsius. Conversely, the friction between a thick media and the roller device may cause the roller device to reach a temperature below the predetermined temperature, resulting in the media cooling to a temperature below the predetermined temperature. Moreover, the temperature of the roller device may need to be adjusted between print jobs, when, for example, the media for the first print job is a thick media and the media for the second print job is a thin media. Thus, efficiently and uniformly regulating the temperature of the roller device may assist with regulating the temperature of the media.

In examples, the roller device includes, among other things a cylinder member rotatable about a longitudinal axis. The cylinder member also includes a wail member, an exterior surface disposed on an outer surface of the wall member, and a plurality of channels disposed within the wall member. The plurality of channels circulate a fluid therein to uniformly regulate a temperature of the cylinder member. The wall surface is disposed adjacent to an intermediate transfer member to press media against the intermediate transfer member to transfer an image from the intermediate transfer member to the media.

Figure 1:
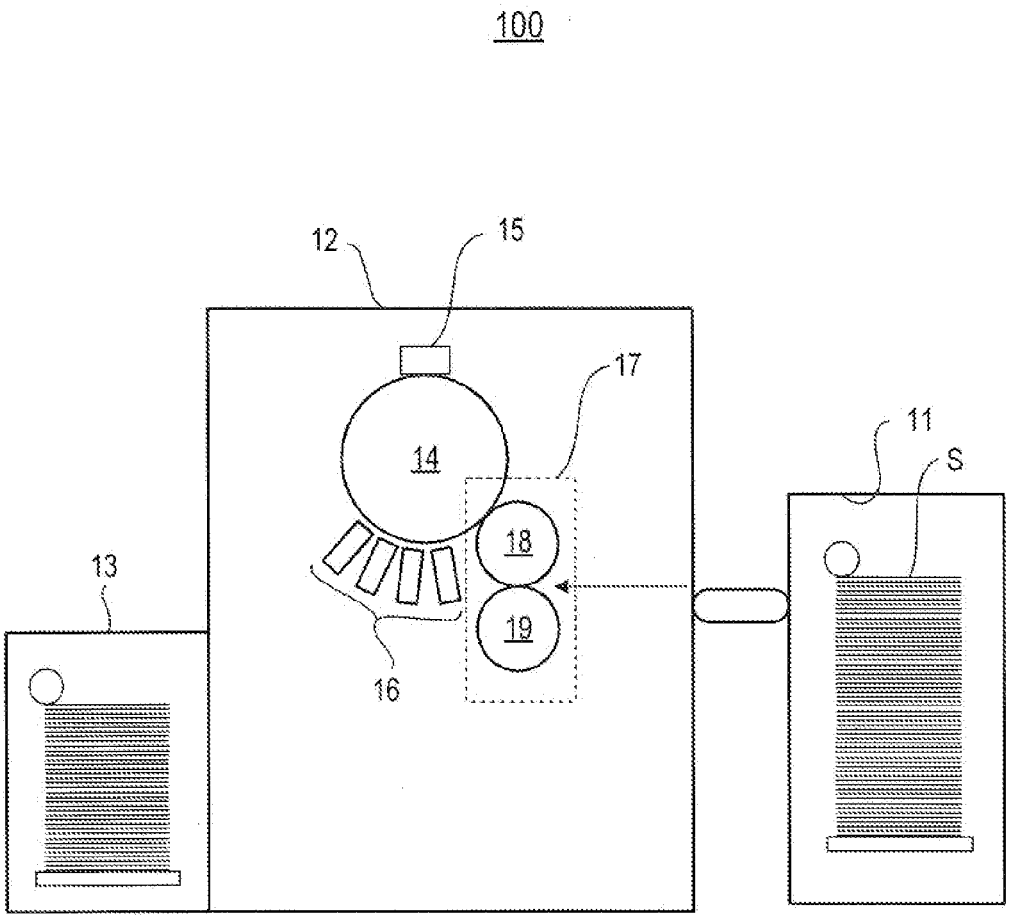
FIG. 1 is a schematic view illustrating a liquid electrophotography system according to an example.

FIG. 1 is a schematic view illustrating an image forming apparatus, such as a liquid electrophotography system (LEP), according to an example. The LEP 100 includes an image forming unit 12 that receives a media S from an input unit 11 and outputs the media S to an output unit 13. The image forming unit 12 includes a photoconductive member 14 on which images can be formed. The photoconductive member 14 may be charged with a suitable charger (not illustrated), such as a charge roller. Portions of the outer surface of the photoconductive member 14 that correspond to the features of the image can be selectively discharged by a laser writing unit 15 to form an electrostatic and/or latent image thereon.

Referring to FIG. 1, the LEP 100 also includes an applicator unit 16 to apply ink, such as a liquid toner, for example, ElectroInk, trademarked by Hewlett-Packard Company, to the electrostatic and/or latent image on the photoconductive member 14. The ink is applied to the photoconductive member 14 to form a fluid image to be transferred to a roller system 17, including an intermediate transfer member (ITM) 18 and a roller device 19, such as an impression member, for example, an impression drum. The ITM 18 receives the fluid image from the photoconductive member 14, heats the fluid image, and transfers the fluid image to the media S. Heat from the ITM 18 may also transfer to the roller device 19. During the transfer of the fluid image from the ITM 18 to the media S, the media S is pinched between the ITM 18 and the roller device 19. Once the fluid image has been transferred to the media S, the media S can be transported to the output unit 13

Figure 2:
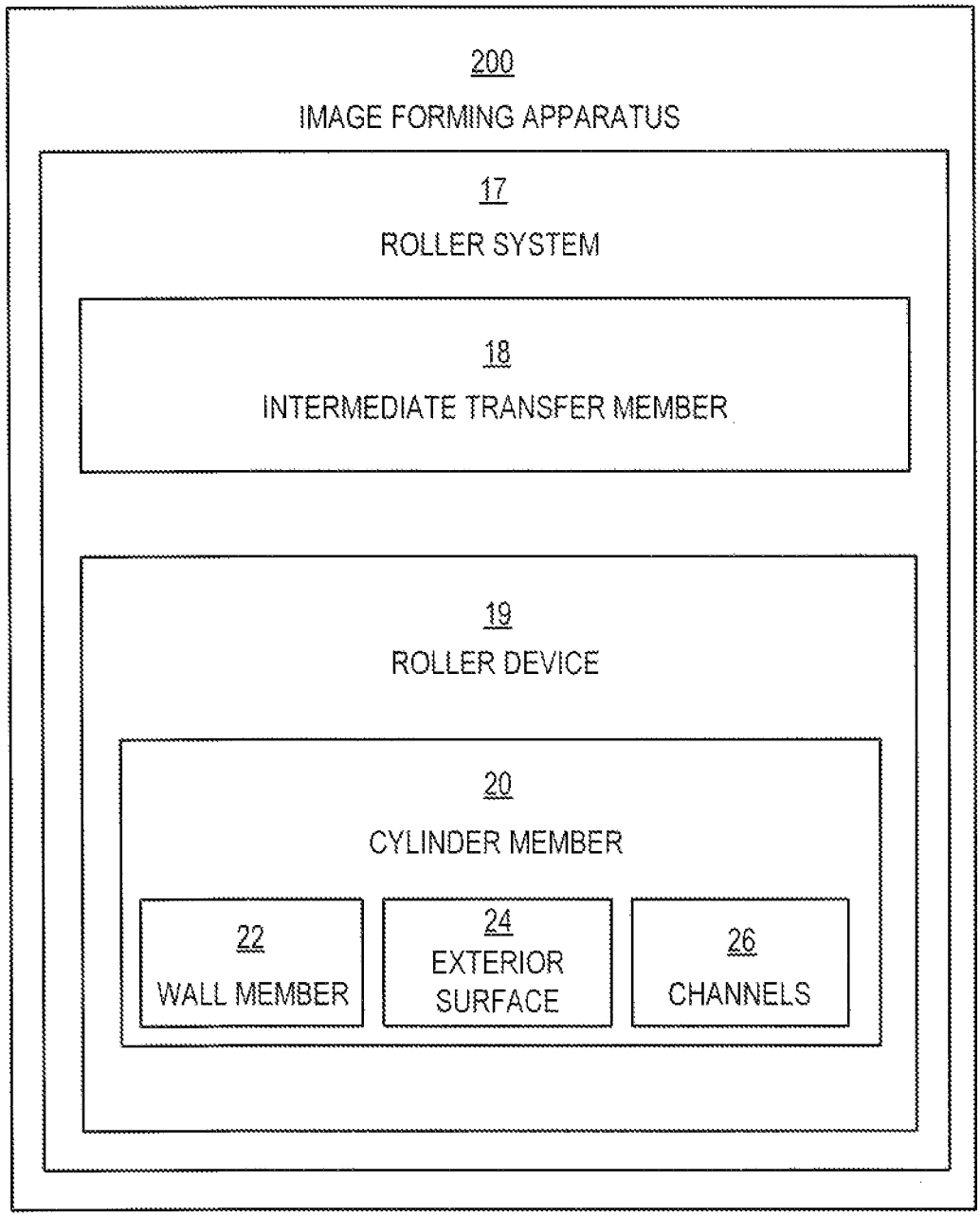
FIG. 2 is a block diagram of an image forming apparatus according to an example.

FIG. 2 is a block diagram illustrating an image forming apparatus 200 according to an example. The image forming apparatus 200 may be a LEP (100). The image forming apparatus 200 includes a roller system 17 with an ITM 18 and a roller device 19. The roller device 19 may be, for example, an impression drum, such as, a cast iron impression drum weighing approximately four hundred kilograms with a diameter of approximately three hundred and ninety millimeters and a length of approximately nine hundred millimeters.

Figure 3:
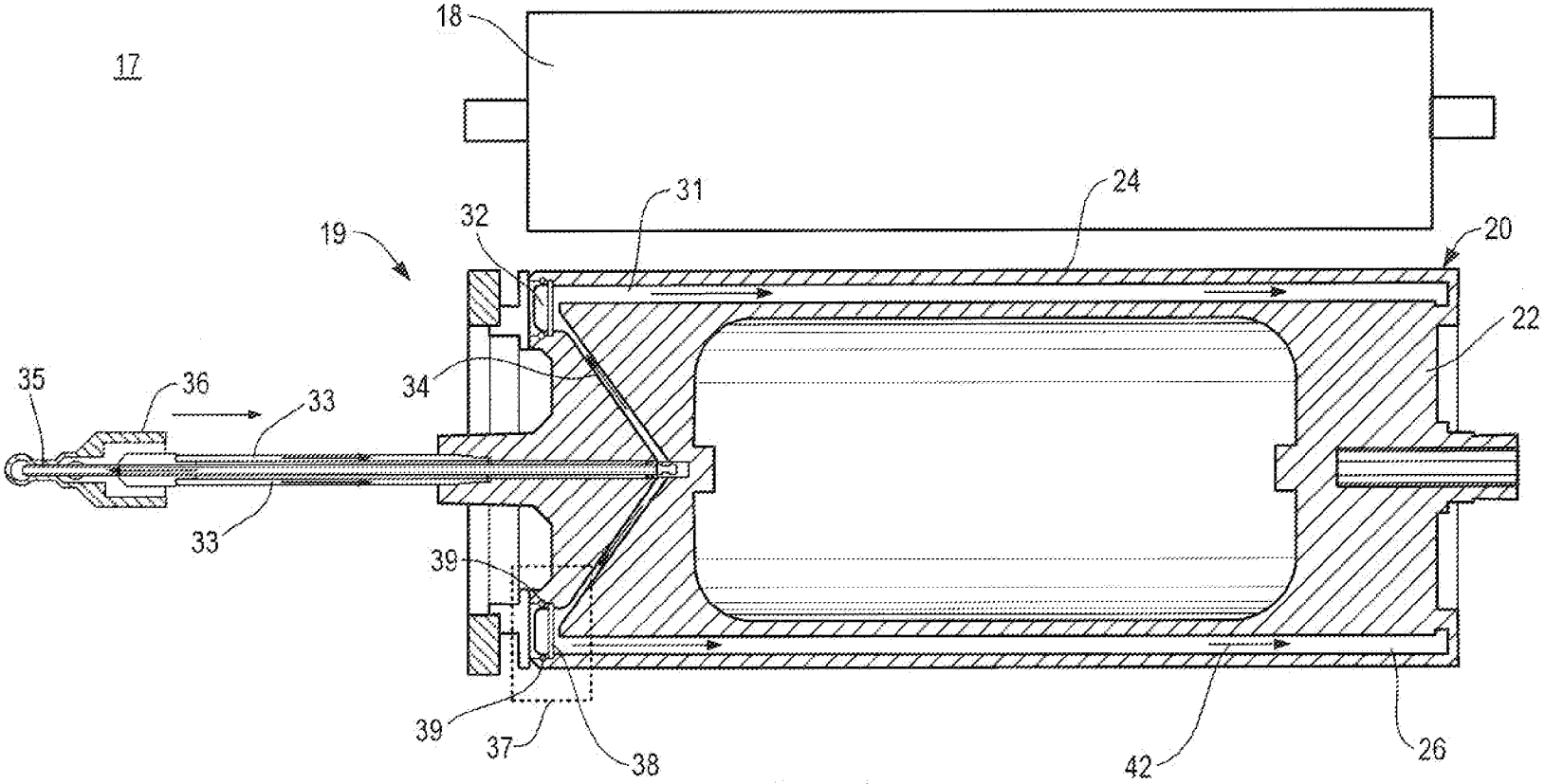
FIG. 3 is a cross-sectional view illustrating a portion of the roller system according to an example.

FIG. 3 illustrates a cross-sectional view of a portion of the longitudinal axis of the roller system 17 according to an example. Referring to FIGS. 2-3, the roller device 19 is disposed adjacent to the ITM 18. The roller device 19 includes a cylinder member 20 rotatable about a longitudinal axis. The cylinder member 20 includes a wall member 22, an exterior surface 24, and a plurality of channels 26. The wall member 22 forms a portion of the cylinder member 20. An outer surface of the wall member 22 forms the exterior surface 24. The exterior surface 24 may be, for example, a circumferential surface. The exterior surface 24 presses the media S against the ITM 18 to transfer the image from the ITM 18 to the media S. An example of the media S is paper, but the media is not limited to paper.

The plurality of channels 26 are disposed within the wall member 22. The plurality of channels 26 may be, for example twenty millimeter holes milled into the wall member 22 A fluid is circulated through the plurality of channels 26 to uniformly regulate a temperature of the cylinder member 20. The fluid circulated may include a temperature regulating substance, such as water, imaging oil, or the like. The arrangement of the plurality of channels 26 may vary. For example, the arrangement of the plurality of channels 26 include a plurality of main channel portions 31 and a plurality of transitional channel portions 32 disposed between at least two of the plurality of main channel portions 31. The configuration of the plurality of channels 26 allow for efficient and uniform circulation of the fluid within the wall member 22, which maintains the temperature of the outer surface 24 of the roller device 19 at a predetermined temperature. This configuration is important during printing, such that the fluid is circulated through the plurality of channels 26 in a manner that maintains the exterior surface 24 at a contestant temperature and/or adjusts the temperature of the exterior surface 24 for increases or decreases thereto.

Moreover, the roller device 19 with the plurality of channels 26 may increase productivity of the image forming apparatus by minimizing the transient time needed to heat and/or cool the roller device 19 between changing of a printing media and/or between print jobs. For example, a fluid, such as water, is circulated through the plurality of channels 26 that extend longitudinally within the wall member 22 close to the exterior surface 24 to efficiently and uniformly heat and/or cool the exterior surface 24. Water may be selected over air due to water's heating capacity of 4.2 KJ/Kg° C. and thermal conductivity of 0.58 Watt/meter° K, which enable the heat flow to be transferred more efficiently with lower mass flow. In such a case, the roller device 10 may be quickly heated and/or cooled, which can reduce the amount of down time between print jobs and increase productivity of the image forming apparatus.

Figure 4:
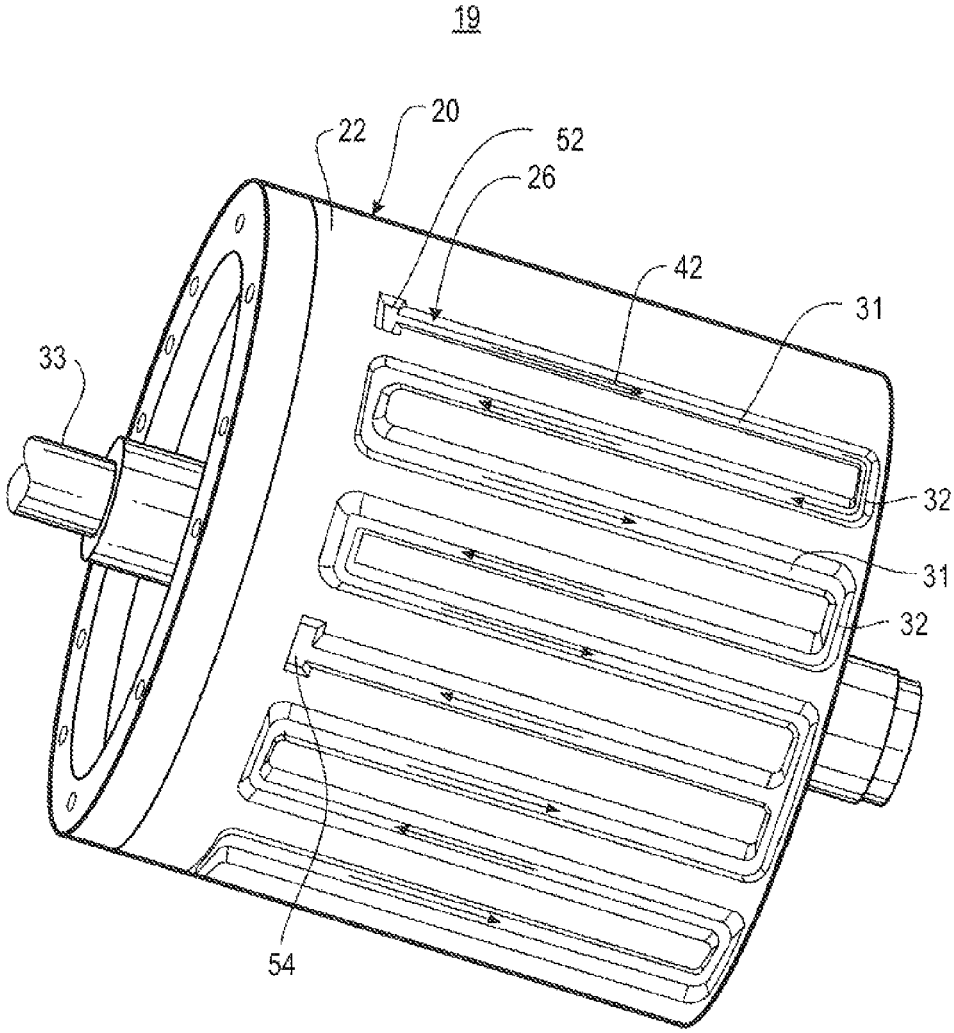
FIG. 4 is a perspective view of a portion of the roller device of FIG. 3 according to an example.
Figure 5:
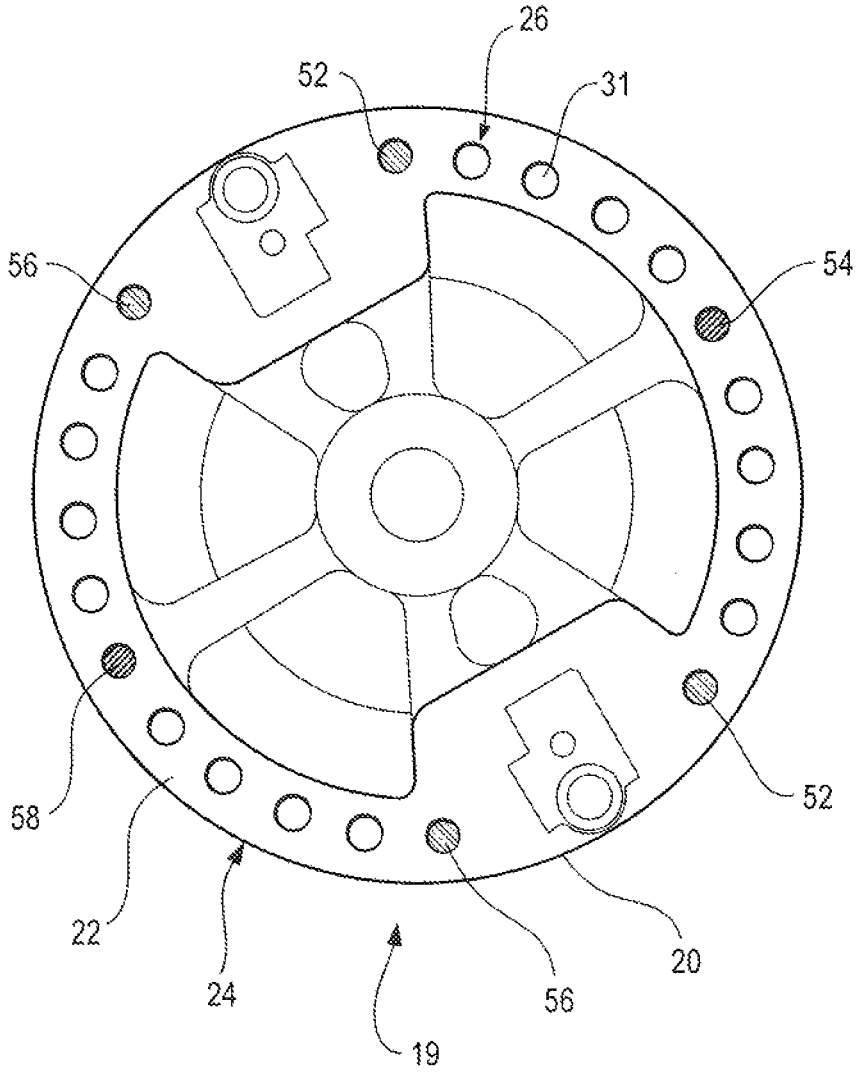
FIG. 5 is a cross-sectional view illustrating a portion of the roller device of FIG. 3 according to an example.

FIG. 4 is a perspective view of a portion of the roller device of FIG. 3 according to an example. FIG. 5 is a cross-sectional view illustrating a portion of the roller device of FIG. 3 according to an example. Referring to FIGS. 3-5, the plurality of main channel portions 31 extend longitudinally across the cylinder member 22 with each of the plurality of main channel portions 31 disposed approximately parallel to each other. As illustrated in FIG. 3, the roller system 17 may further include an inlet tube 33 attached to the cylinder member 20 of the roller device 19 to transport the fluid to the plurality of channels 26, and an outlet tube 35 attached to the cylinder member 20 to transport the fluid out of the plurality of channels 26.

For example, the inlet tube 33 may connect to at least one of the plurality of channels 26 to circulate the fluid throughout the plurality of channels 26. The inlet tube 33 may be connected directly to at least one of the plurality of main channel portions 31, the plurality of transitional channel portions 32, and/or inlet auxiliary tubes 34 to assist with providing the fluid to the plurality of channels 26 from the inlet tube 33. The outlet tube 35 may similarly be connected to at least one of the plurality of main channel portions 31, the plurality of transitional channel portions 32, and/or outlet auxiliary tubes (not illustrated) to assist with transporting the fluid out of the plurality of channels 26 through the outlet tube 35.

The rotary joint 36 may connect to the inlet tube 33 and the outlet tube 35 to enable rotation of the roller device 19, while enabling linear fluid flow into and/or out of the roller device 19. The rotary joint 36 may also connect the inlet tube 33 and/or the outlet tube 35 to the roller device 19. The inlet tube 33 may, for example, encase the outlet tube 35 between the rotary joint 36 and the roller device 19, as illustrated in FIG. 3. For example, the inlet tube 33 may pass through the rotary joint 36, extend to the roller device 19, and connect to the plurality of channels 26. The fluid may flow from the inlet tubes 33 inside the roller device 19 and spread towards the exterior surface 24 in a radial direction through the roller device 19 to the plurality of main channel portions 31, which extend longitudinally therein. The plurality of main channel portions 31 may also be connected to the outlet tube 35, which may be connected to the rotary joint 36 to take the fluid out of the plurality of channels 26 through the rotary joint 36. Further, the connection to the rotary joint 36 includes a seal to prevent fluid from leaking.

FIGS. 4-5 illustrate an example of the roller device 19 fluid paths 42, where the plurality of main channel portions 31 are disposed approximately parallel to each other. The arrows of FIG. 4 illustrate the fluid path 42 through the plurality of main channel portions 31 and the plurality of transitional channel portions 32. For example, FIGS. 4-5 illustrate the fluid path 42 provided from the inlet tube 33 to four of the plurality of main channel portions 31, indicated as references 52 and 56. The fluid is circulated through the plurality of main channel portions 31 and the plurality of transitional channel portions 32 of the plurality of channels 26 until the fluid reaches two of the plurality of main channel portions 31, indicated as references 54 and 58, which are connected to the outlet tube 35 to transport the fluid out of the plurality of channels 26. Note, the fluid may be provided to the plurality of main channel portions 31 within the wall member 22 (i.e., references 52, 56) and transported out of the plurality of channels 26 at multiple locations (i.e., references 54, 58). As illustrated in the example, the inlet tubes 33 may provide the fluid to the plurality of main channel portions 31 within the wall member 22 and the fluid may be transported out of the plurality of channels 26 via a single outlet tube 35.

Figure 6A:
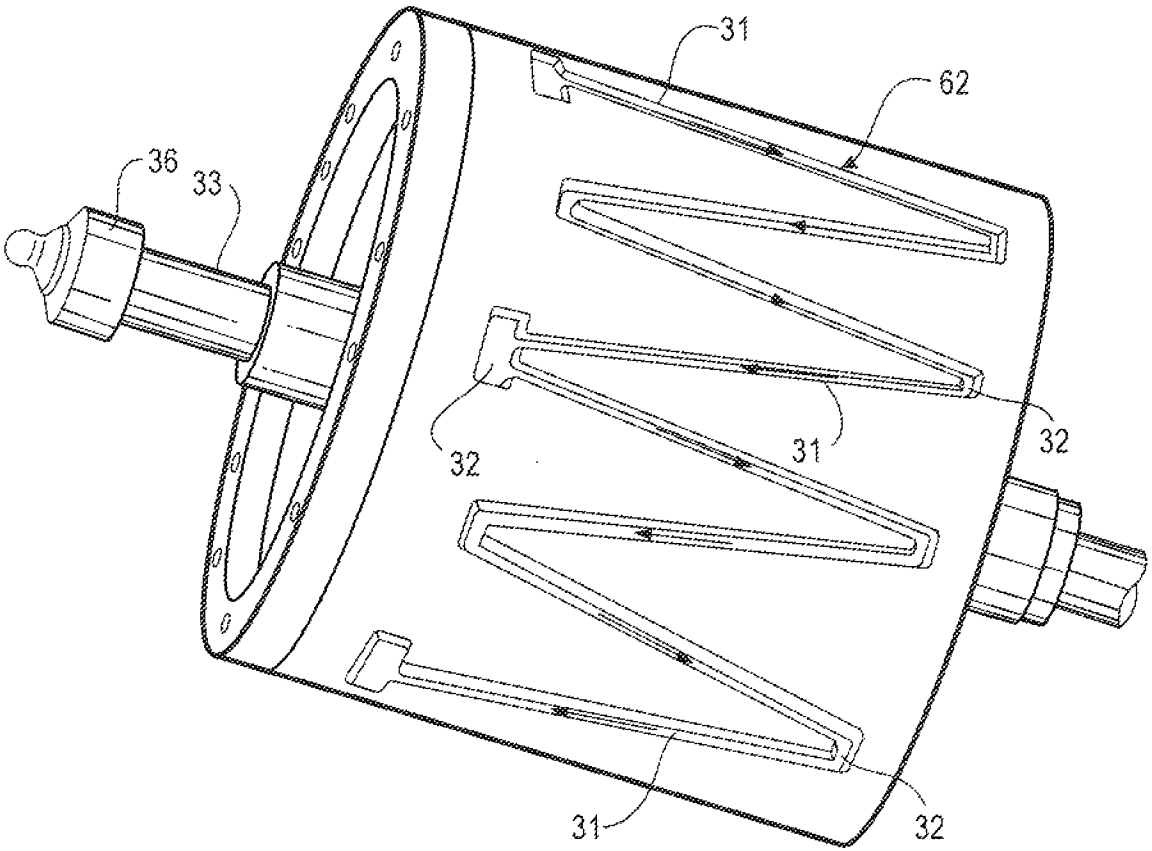
FIGS. 6A and 6B are perspective views of portions of the roller device according to examples.
Figure 6B:
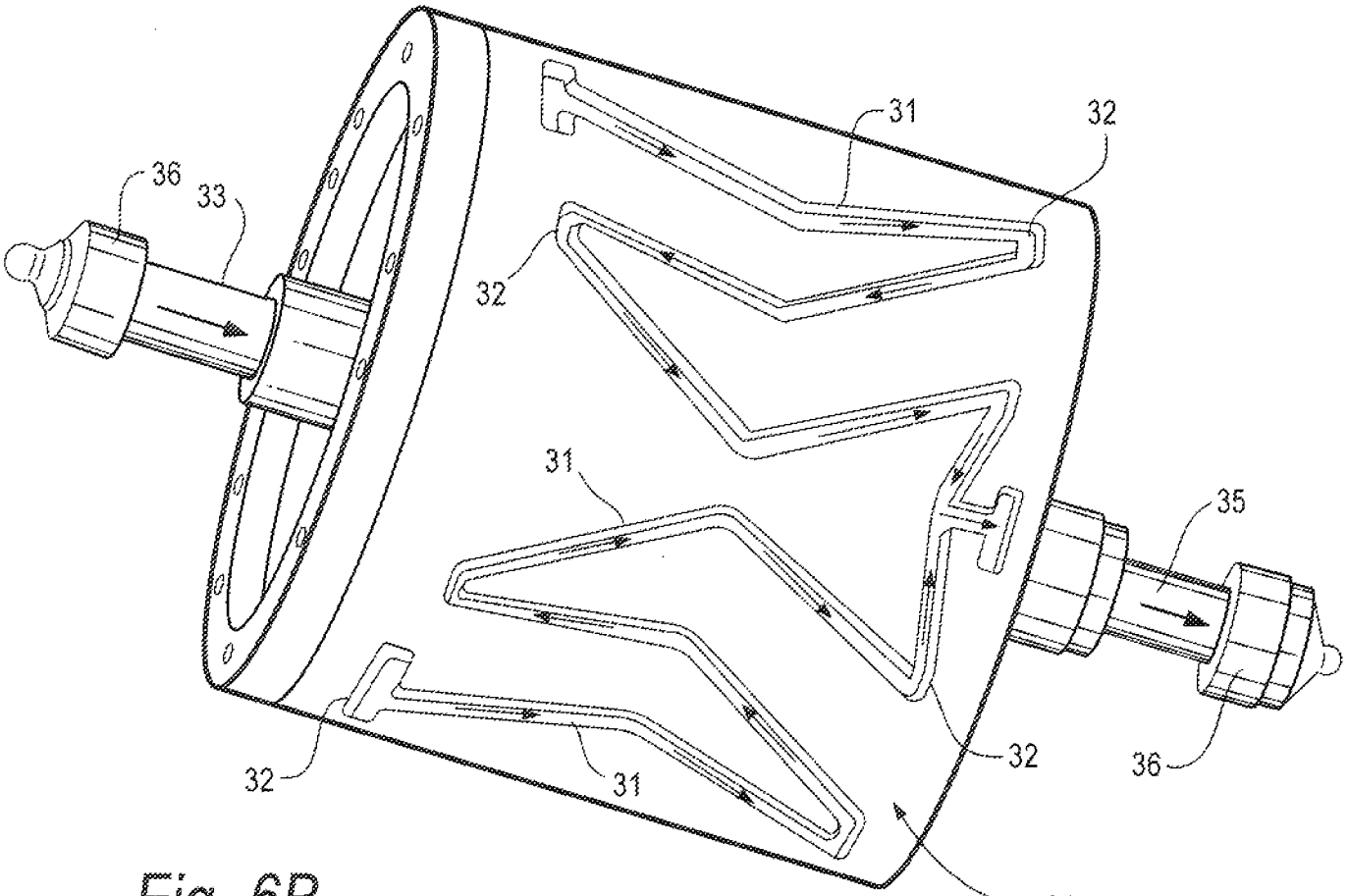

FIGS. 6A and 6B provide further examples of the fluid path 42 through the plurality of channels 26 in the wall member 22 using two additional channel configurations. The examples in FIGS. 6A and 6B illustrate the fluid path 42 with arrows and the plurality of transitional channel portions 32 disposed between at least two of the plurality of main channel portions 31. Referring FIG. 6A, an example of the plurality of main channel portions 31 extending longitudinally across the cylinder member 20 in a skewed arrangement 62 is illustrated. FIG. 6A also illustrates that the inlet tube 33 and outlet tube 35 may located on the same side of the roller device 19 with a dual flow rotary joint 36; however, the inlet tube 33 and the outlet tube 35 may be located on opposite sides of the roller device 19, as illustrated in FIG. 6B. Referring to FIG. 6B, an example of the plurality of main channel portions 31 that extend longitudinally across the cylinder member 20 in a traverse arrangement 64 is illustrated. FIG. 6B illustrates the flow of the fluid, such that the fluid enters the cylinder member 20 through the inlet tube 33 on the left side and exits through the outlet tube 35 located on the right side of the roller device 19. Note that the example illustrated in FIG. 6B includes two rotary joints 36. One rotary joint 36 is attached to the inlet tube 33 and the other rotary joint 36 is connected to the outlet tube 36.

As illustrated in FIGS. 4-6B, the plurality of main channel portions 31 extend longitudinally across the roller device 19 to uniformly regulate the temperature of the roller device 19. For example, the plurality of main channel portions 31 may include one of the plurality of main channel portions 31 extending longitudinally across the cylinder member 20, as illustrated in FIGS. 4 and 6A below and/or the plurality of main channel portions 31 that, as a whole, extend longitudinally across the cylinder member 20, as illustrated in FIG. 6B. By having the plurality of channels extend longitudinally across the roller device 19, the fluid circulated through the plurality of channels 26 may efficiently and uniformly regulate the temperature of the roller device 19, as the plurality of channels 26 illustrated in the examples provide heating and/or cooling over the longitudinal area of the roller device 19.

Referring back to FIG. 3, the roller device may further include a sealing unit 37 in the wall member 22 to seal the fluid within the plurality of channels 26 and enable circulation of the fluid through the plurality of channels 26. The sealing unit 37 is illustrated as being disposed in the plurality of transitional channel portions 32. The sealing unit 37 may include at least one of an o-ring 38 and a gasket 39 to seal the wall member 22 of the cylinder member 20. As illustrated in FIG. 3, the wall member 22 may be, for example, plugged and sealed in the plurality of transitional channel portions 32 through use of an o-ring 38 and a gasket 39. The sealing unit 37 is designed to prevent leakage of the fluid after the plurality of channels 26 are drilled into the side of the wall member 22.

Figure 7:
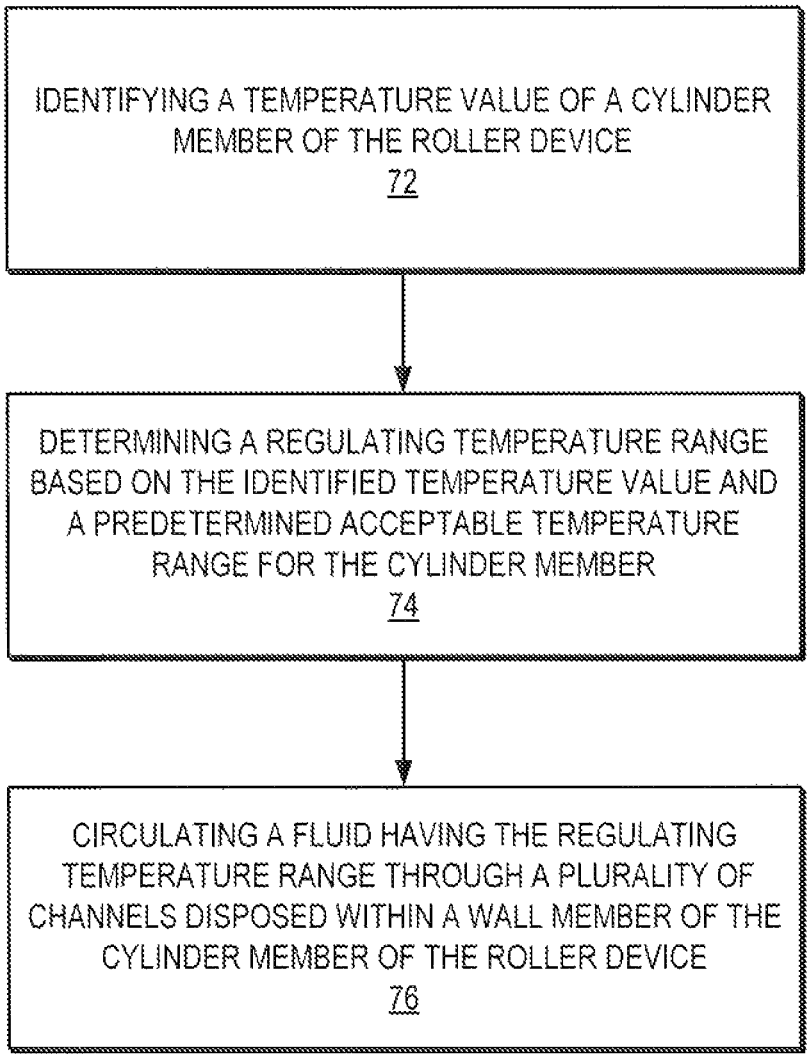
FIG. 7 is a flowchart illustrating a method of regulating temperature of a roller device of an image forming apparatus according to an example.

FIG. 7 is a flowchart illustrating a method 700 of regulating temperature of a roller device of an image forming apparatus according to an example. Referring to FIG. 7, in block 72, a temperature value of the cylinder member 20 of the roller device 19 is periodically identified. In block 74, a regulating temperature range is determined based on the identified temperature value and a predetermined acceptable temperature range for the cylinder member 20. For example, the regulating temperature range may be between forty-seven degrees Celsius and fifty-three degrees Celsius or between forty-nine degrees Celsius and fifty-one degrees Celsius. In block 76, a fluid having the regulating temperature range is circulated through a plurality of channels 26 disposed within a wall member 22 of the cylinder member 20 of the roller device 19. The method 700 may be repeated at regular and/or irregular intervals depending on the desired schedule.

The method 700 may, for example, measure the temperature value of the exterior surface 24 of the cylinder member 20. Then, based on the temperature value, the fluid that is circulated through the plurality of channels 26 may be transported out of the cylinder member 20 to a temperature regulating device (i.e., via the outlet tube 35), where the fluid is placed in a tank and reused. The temperature regulating device may maintain the fluid at the regulating temperature range by alternating circulation of the fluid through a heater in a heating mode and a heat exchanger connected to a cooling device in a cooling mode, based on the identified temperature value of the cylinder member 20. For example, the cooling device may provide chilled fluid to the heat exchanger to lower or cool the temperature of the fluid.

The method 700 may alternate between a heating mode and a cooling mode based on the temperature of the cylinder member 20 to efficiently and uniformly maintain and/or change the temperature of the roller device for high quality printing. For example, the temperature of the cylinder member 20 may be maintained using the method 700. When the identified temperature value reaches, for example, three or more degrees Celsius over the predetermined acceptable temperature range, the heaters may be turned off and the heat exchanger may receive chilled fluid from the cooling device. In the cooling mode, after the fluid is sent through the heat exchanger, the cooled fluid may be circulated back into the plurality of channels 26 (i.e., via the inlet tube 33). Similarly, when the temperature value of the cylinder 20 is, for example, three or more degrees Celsius under the predetermined acceptable temperature range, the heater may be turned on and the fluid may be circulated through the temperature regulating device to be heated. In the heating mode, the fluid that is circulated through a heater to heat the fluid and may be circulated back through the plurality of channels 26 (i.e., via the inlet tube 33).

Moreover, the method 700 may be repeated continually and/or periodically to monitor the temperature value of the cylinder member 20 to verify that the cylinder member 20 is being kept within the predetermined acceptable temperature range. An example includes repeating one or more of the following: the identification of the temperature value of the cylinder member 20 (block 72), the determination of the regulating temperature range (block 74), and the circulation of the fluid with the regulating temperature range (block 76). When the temperature is within the predetermined acceptable temperature range, the fluid continues to circulate; however, when the temperature value of the cylinder member is outside the predetermined acceptable temperature range the regulating temperature range is adjusted accordingly. Furthermore, the heater and/or heat exchanger may adjust to heat and/or cool the fluid at different rates depending on the identified temperature value. Adjusting the rate of heating and/or cooling allows the method 700 in combination with the roller device 19 to efficiently and uniformly maintain and/or change the temperature of the fluid circulated through the plurality of channels 26 in the roller device 19 during printing.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to." It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A roller device usable with an image forming apparatus including an intermediate transfer member, the roller device comprising:

a cylinder member rotatable about a longitudinal axis extending therethrough, the cylinder member including a wall member, an exterior surface disposed on an outer surface of the wall member and a plurality of channels milled in the wall member, the plurality of channels to circulate a fluid therein to uniformly regulate a temperature of the exterior surface, and the exterior surface disposed adjacent to the intermediate transfer member to press media against the intermediate transfer member to transfer an image from the intermediate transfer member to the media; and a sealing unit in the wall member to seal the fluid within the plurality of channels.

2. The roller device according to claim 1, wherein the plurality of channels include:

a plurality of main channel portions; and a plurality of transitional channel portions disposed between at least two of the plurality of main channel portions.

3. The roller device according to claim 2, wherein the sealing unit is disposed in the plurality of transitional channel portions including at least one of a gasket and an o-ring.

4. The roller device according to claim 2, wherein the plurality of main channel portions extend longitudinally therein.

5. The roller device according to claim 2, wherein at least two of the plurality of main channel portions are disposed parallel to each other.

6. The roller device according to claim 2, wherein at least two of the plurality of main channel portions are disposed in at least one of a skewed arrangement with respect to each other and a traverse arrangement with respect to each other.

7. The roller device according to claim 1, further comprising:

an inlet tube to provide the fluid to the plurality of channels; and an outlet tube to transport the fluid out of the plurality of channels.

8. The roller device according to claim 1, wherein the fluid comprises water.

9. A roller system usable with an image forming apparatus, the roller system comprising:

an intermediate transfer member to transfer an image thereon to media; and a roller device disposed adjacent to the intermediate transfer member, the roller device including a cylinder member rotatable about a longitudinal axis extending therethrough, the cylinder member including a wall member, an exterior surface disposed on an outer surface of the wall member and a plurality of channels milled in the wall member, the plurality of channels to circulate a fluid therein to uniformly regulate a temperature of the exterior surface, the exterior surface to press media against the intermediate transfer member to transfer the image from the intermediate transfer member to the media, and a sealing unit in the wall member to seal the fluid within the plurality of channels.

10. The roller system according to claim 9, wherein the plurality of channels include:

a plurality of main channel portions; and a plurality of transitional channel portions disposed between at least two of the plurality of main channel portions.

11. The roller system according to claim 10, wherein the sealing unit is disposed in the plurality of transitional channel portions including at least one of a gasket and an o-ring.

12. The roller system according to claim 10, wherein the plurality of main channel portions extend longitudinally therein.

13. The roller system according to claim 12, wherein at least two of the plurality of main channel portions are disposed parallel to each other.

14. The roller system according to claim 11, wherein at least two of the plurality of main channel portions are disposed in at least one of a skewed arrangement with respect to each other and a traverse arrangement with respect to each other.

15. The roller system according to claim 9, further comprising:

an inlet tube to provide the fluid to the plurality of channels; and an outlet tube to transport the fluid out of the plurality of channels.

16. The roller system according to claim 15, further comprising a rotary joint to enable rotation of the roller device about the longitudinal axis and to connect at least one of the inlet tube and the outlet tube to the roller device.

17. The roller system according to claim 10, wherein the fluid comprises water.

18. A method of regulating a temperature of a roller device of an image forming apparatus, the method comprising:

periodically identifying a temperature value of a cylinder member of the roller device;

determining a regulating temperature range based on the identified temperature value and a predetermined acceptable temperature range for the cylinder member; and circulating a fluid having the regulating temperature range through a plurality of channels milled in a wall member of the cylinder member of the roller device, the wall member including a sealing unit to seal the fluid within the plurality of channels.

19. The method according to claim 18, wherein the regulating temperature range is between forty-seven degrees Celsius and fifty-three degrees Celsius.

20. The method according to claim 18, wherein a temperature regulating device maintains the fluid at the regulating temperature range by alternating circulation of the fluid through a heater and a heat exchanger connected to cooling device based on the identified temperature value of the cylinder member.

* * * * *